United States Patent [19]

Conley

[11] 4,095,711

[45] Jun. 20, 1978

[54] HANDLE ASSEMBLY

[75] Inventor: James Robert Conley, Wichita, Kans.

[73] Assignee: The Coleman Company, Inc., Wichita, Kans.

[21] Appl. No.: 716,164

[22] Filed: Aug. 20, 1976

[51] Int. Cl.[2] ..... B65D 25/28

[52] U.S. Cl. ..... 220/94 R; 16/112; 16/115; 224/45 P

[58] Field of Search ..... 220/94 R, 95, 92; 16/115, 110 R, 112, 126, 110.5; 224/45 C, 45 P, 46 R

[56] References Cited

U.S. PATENT DOCUMENTS

| | | | |
|---|---|---|---|
| 597,217 | 1/1898 | Loery | 220/94 R |
| 2,323,094 | 6/1943 | Levin | 16/115 |
| 2,427,004 | 9/1947 | Kampf | 224/45 P |
| 2,697,244 | 12/1954 | Lincke | 16/126 |
| 3,158,284 | 11/1964 | Henchert et al. | 16/126 |
| 3,259,086 | 7/1966 | Stein | 16/126 |
| 3,412,887 | 11/1968 | Swartwood et al. | 220/94 R |
| 3,795,941 | 3/1974 | Szabo | 16/115 |
| 3,886,625 | 6/1975 | Rollband | 16/112 |
| 3,933,269 | 1/1976 | Mastrovito | 16/112 |

FOREIGN PATENT DOCUMENTS

| | | | |
|---|---|---|---|
| 875,959 | 7/1949 | Germany | 220/95 |
| 291,564 | 6/1928 | United Kingdom | 220/94 |

*Primary Examiner*—William Price
*Assistant Examiner*—Allan N. Shoap
*Attorney, Agent, or Firm*—Tilton, Fallon, Lungmus & Chestnut

[57] ABSTRACT

A handle assembly is provided for carrying a container such as a cooler. The assembly includes a bracket having a pair of spaced mounting members, a pin extending from each of the mounting members, and a handle having a member terminating in a pair of pin-receiving channels joined to a pair of spaced grip members. The assembly utilizes the pins for rotating or sliding the handle with respect to the bracket. The container can be carried by moving the handle from a resting position to a carrying position using one of two distinct modes of movement provided by the handle assembly.

12 Claims, 6 Drawing Figures

FIG. 1
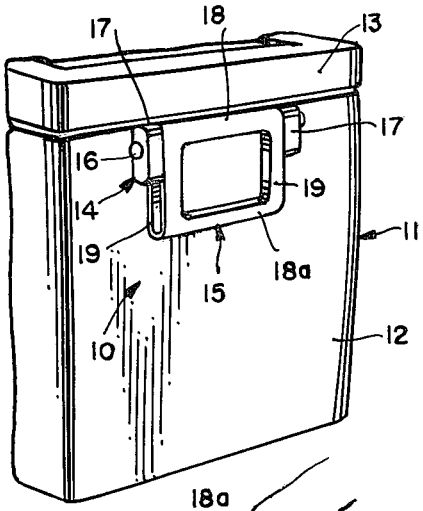
FIG. 2
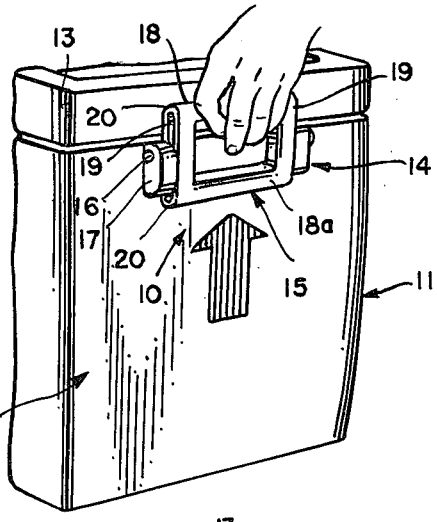
FIG. 3
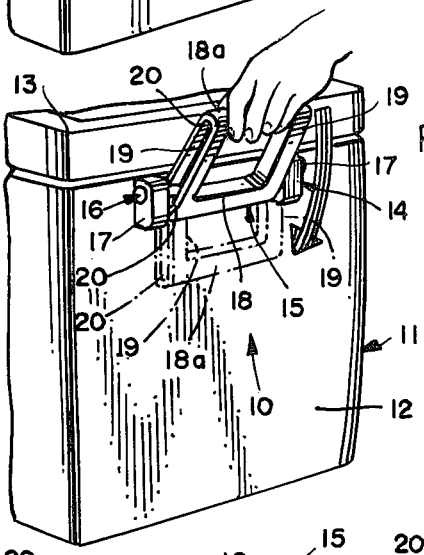
FIG. 4
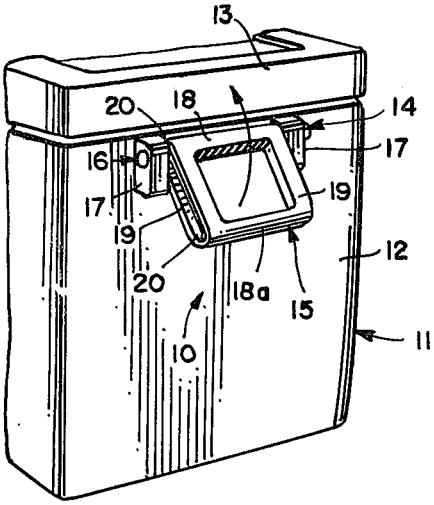
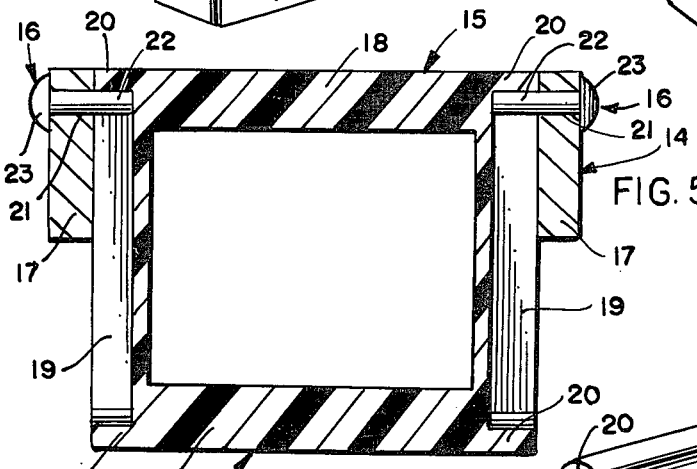
FIG. 5
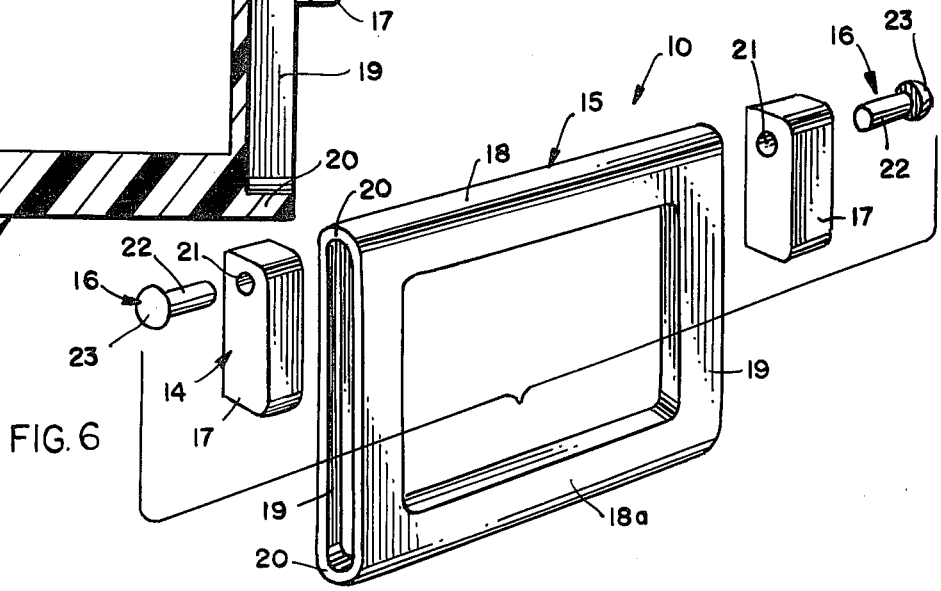
FIG. 6

HANDLE ASSEMBLY

BACKGROUND OF THE INVENTION

The present invention relates to a handle assembly and more particularly to a handle assembly for carrying a container such as a cooler.

A cooler is generally an insulated container having walls upstanding from a bottom member which define a top opening adapted to receive a removeable cover. Coolers are oftentimes rectangular having two sidewalls and two end walls and a handle assembly is usually associated with each of the end walls for carrying the cooler. The present invention is directed to a handle assembly particularly well suited for carrying a cooler which provides advantages over constructions previously used.

The handle assemblies commonly provided on coolers in the past have generally been of two principal types. The first type has been in the form of a narrow recess in opposing end walls which can be gripped by the finger tips of the user. This type of handle assembly is normally adequate for purposes of removing a cooler which has been packed for transportation in close proximity to other items, but the narrow recess provides an unsatisfactory gripping surface resulting in a significant strain on the fingers of the user especially at times when the cooler is heavily loaded. The second type has been in the form of a conventional handle which is pivotally mounted on a bracket attached to opposing end walls which can be gripped by the hand of the user. This type of handle assembly is normally adequate for purposes of providing a satisfactory gripping surface for the user even at times when the cooler is heavily loaded, but the pivotally mounted handle cannot be moved into position for carrying a cooler which has been packed for transportation in close proximity to other items. Accordingly, the two principal types of handle assemblies commonly used have not effectively provided the degree of versatility desired for use in carrying a cooler under a wide variety of conditions.

The handle assemblies provided on containers used for various other purposes in the past have been of a number of different configurations. A representative sampling of such handle assemblies includes Litchfield U.S. Pat. No. 340,721; Paddock U.S. Pat. No. 2,318,792; and Johnson U.S. Pat. No. 3,451,590. However, the handle assemblies of the past have all failed to accomplish the important advantages to be derived from the present invention.

SUMMARY OF THE INVENTION

The handle assembly of the present invention is particularly well suited for carrying a container such as a cooler. The assembly includes a bracket attached to the cooler having a pair of spaced mounting members, a pin extending from each of the mounting members and a handle connected to the bracket having member terminating a pair of pin-receiving channels joined to a pair of spaced grip members. The channels are preferably parallel with the grip members preferably being perpendicular to the channels. The mounting members can advantageously be made to project from the container with the pins extending inwardly through apertures in the mounting members. The handle preferably includes the channels generally being U-shaped and facing outwardly to receive the pins adjacent the mounting members.

The present invention having these various features offers the significant advantage of being movable from a resting position to a carrying position by utilizing one of two distinct modes of movement provided by the handle assembly.

The present invention overcomes the inherent limitations of the two principal types of handle assemblies commonly used on coolers in the past. A handle is provided which the user can slide or rotate into a carrying position. The sliding movement can be utilized at times when there is a limited clearance adjacent the handle and the rotating movement can be utilized at other times. A handle is also provided which the user can grip firmly by the hand in a carrying position. Accordingly, the present invention provides advantages in a handle assembly for carrying a cooler which is often heavily loaded and packed for transportation with other items in close proximity.

It is therefore an object of the present invention to provide a handle assembly for carrying a container such as a cooler having two distinct modes of movement from a resting position into a carrying position. The provision of the structure and the realization of the advantages derived therefrom constitute additional important objects of this invention. Other objects of the present invention can be appreciated from the details of construction and operation set forth in the accompanying specifications, claims and drawings.

BRIEF DESCRIPTION OF THE DRAWINGS

An illustrated embodiment of a handle assembly constructed in accordance with the present invention is shown in the accompanying drawings, in which FIG. 1 is a fragmentary perspective view of a container such as a cooler equipped with a handle assembly in accordance with the present invention;

FIG. 2 is a fragmentary perspective view of the cooler of FIG. 1 illustrating the handle being slid vertically upward into a carrying position;

FIG. 3 is a fragmentary perspective view of the cooler of FIG. 1 illustrating the handle being rotated downward into a resting position;

FIG. 4 is a fragmentary perspective view of the cooler of FIG. 1 illustrating the handle being rotated upward into a carrying position;

FIG. 5 is an enlarged sectional view taken on line 5–5 of FIG. 1 illustrating the handle assembly; and FIG. 6 is an enlarged exploded perspective view illustrating the handle assembly of FIG. 1.

DETAILED DESCRIPTION OF INVENTION

In the illustration given and with reference first to FIG. 1, the numeral 10 designates generally a handle assembly in accordance with the present invention. The handle assembly 10 has been shown attached to a cooler 11 having an end wall 12 with a removeable top 13 resting thereon primarily for purposes of illustrating one of many advantageous applications of the invention. The details of construction of the cooler 11 are therefore not believed to be important for purposes of obtaining a thorough and proper understanding of the invention. Accordingly, it will be understood throughout the description which follows that the handle assembly 10 is equally well suited for use on many different types of containers within the contemplation of the present invention.

The handle assembly 10, which is provided for carrying the cooler 11, generally includes a bracket 14, a handle 15, and pins 16. The bracket 14 is attached to the end wall 12 and includes a pair of spaced mounting members 17. The pins 16 are operatively associated with the bracket 14 (as shown in FIG. 5) so that one pin 16 extends from each of the mounting members 17. The handle 15 is connected to the bracket 14 and has a pair of pin-receiving channels 19 joined to a pair of spaced members 18 and 18*a*. The handle 15 can be moved on the pins 16 with respect to the bracket 14 into position for carrying the cooler 11 by utilizing one of two distinct modes of movement provided by the handle assembly 10.

Referring to FIG. 5, the details of the handle 15 can be more fully understood. The channels 19 are preferably parallel and the ends 20 of the channels 19 are closed. The grip member 18 is generally perpendicular to the channels 19 in typical handle fashion and the second grip member 18*a* can advantageously join the ends 20 of the channels 19 remote from the grip members 18. The handle 15 is therefore preferably provided in a generally rectangular shape.

The channels 19 are generally U-shaped (as shown in FIG. 6) and face outwardly to receive the inwardly extending pins 16. The width of the opening in the channels 19 is substantially the same as or just slightly greater than the diameter of the pins 16 to facilitate sliding movement therebetween. The ends 20 confine movement of the pins 16 within the channels 19 and are generally rounded to conform to the shape of the pins 16. The diameter of the rounded portion of the ends 20 is similarly substantially the same as or just slightly greater than the diameter of the pins 16 to facilitate rotating movement therebetween. The rounded ends 20 and the U-shaped channels 19 are therefore designed to provide the two distinct modes of movement.

The grip members 18 and 18*a*, which are substantially identical, preferably have generally rounded outer surfaces to conform to the shape of the rounded ends 20 of the channels 19. The ends 20 and the grip members 18 and 18*a* can therefore advantageously define a continuous rounded outer surface which facilitates rotation of the handle 15. The grip members 18 and 18*a* can also be generally rounded along the inner surfaces or the inner surfaces can be flattened or undulating to conform to the fingers of the user upon gripping the handle assembly 10.

Referring again to FIG. 1, the mounting members 17 preferably project perpendicularly from the end wall 12 of the cooler 11 and include apertures 21 through which the pins 16 extend inwardly into the outwardly facing channels 19. The apertures 21 and the pins 16 are sufficiently spaced from the end wall 12 to permit free movement of the handle 15 on the pins 16. The pins 16 include shank portions 22 and head portions 23 (as shown in FIG. 5) with the diameter of the shank portions 22 being substantially the same as the diameter of the apertures 21 and the diameter of the head portions 23 being greater than the diameter of the apertures 21. The longitudinal axes of the pins 16 preferably coincide with the pins 16 being generally parallel to the end walls 12 of the cooler 11 and generally perpendicular to the mounting members 17.

The bracket 14 can include only the mounting members 17 (as shown in FIGS. 1 through 4) attached directly to the end wall 12 of the cooler 11 or can also include a plate (not shown) linking the mounting members 17. If the plate is used, it can advantageously be integral with the mounting members 17 for direct attachment to the cooler 11 in order to indirectly secure the mounting members 17 in position. The bracket 14 can be attached to the end wall 12 of the cooler 11 in any conventional manner (not shown) exhibiting the strength characteristics required to support the handle 15 connected thereto for lifting a heavily loaded cooler.

The handle assembly 10 of the present invention can be applied to a cooler 11 in a simple and inexpensive manner. The mounting members 17 of the bracket 14 are attached to the end wall 12 of the cooler 11 in any conventional manner separated by a distance generally defined by the width of the handle 15. The handle 15 is then placed between the mounting members 17 with the U-shaped channels 19 facing outwardly in alignment with the apertures 21. The pins 16 are driven inwardly through the apertures 21 to extend into the channels 19 for confined movement of the handle 15. The handle assembly 10 of the present invention is then ready for use for carrying the cooler 11.

Referring to FIG. 1, the handle assembly 10 is shown in a resting position. The handle assembly 10 can be moved to a carrying position at times when the cooler 11 is packed for transportation with other items in close proximity to the handle 15 by simply grasping the grip member 18 and sliding the handle 15 vertically upward on the pins 16 (as shown in FIG. 2) until the pins 16 come into contact with the lower rounded ends 20 of the channels 19 adjacent the grip member 18*a*. The grip member 18 will then extend slightly above the top 13 of the cooler 11 and can be easily grasped by the hand of the user to lift the cooler 11 from confinement between the other items packed nearby. The handle 15 can be moved from a resting position to a carrying position at other times by simply grasping the grip member 18*a* and rotating the handle 15 vertically upward about the pins 16 (as shown in FIG. 4) which are in engagement with the upper rounded ends 20 of the channels 19 adjacent the grip member 18. The grip member 18*a* will then extend slightly above the top 13 of the cooler 11 and can likewise be easily grasped by the hand of the user to lift the cooler 11.

The handle assembly 10 can be moved from a carrying position to a resting at times when the cooler 11 is packed for transportation with other items in close proximity to the handle 15 by simply grasping the grip member 18 and sliding the handle 15 vertically downward on the pins 16 in the opposite direction from that shown in FIG. 2 until the pins 16 come into contact with the upper rounded ends 20 of the channels 19 adjacent the grip member 18. The handle 15 can be moved from a carrying position to a resting position at other times by simply grasping the grip member 18*a* and rotating the handle 15 vertically downward about the pins 16 (as shown in FIG. 3) which are in engagement with the upper rounded ends 20 of the channels 19 adjacent the grip member 18. Accordingly, the handle assembly of the present invention provides two distinct modes of movement which can selectively be utilized to move the handle from a carrying position to a resting porition or to move the handle from a resting position to a carrying position depending upon external conditions.

The handle assembly is most useful for carrying a container such as a cooler but such assemblies have previously not been fully adaptable for use under a wide variety of conditions. The problem of lifting a cooler for removal at times when other items have been packed in close proximity to the handles has not been overcome by prior handle assemblies. The present invention is designed to overcome the shortcomings of prior assemblies by providing a simple, inexpensive device which can quickly and easily be used under a wide variety of conditions to provide the desired degree of versatility in a handle assembly.

While in the foregoing specification a detailed description of the invention has been set forth for the purpose of illustration, variations of the details herein given may be made by those skilled in the art without departing from the spirit and scope of the invention.

I claim:

1. A handle assembly for carrying a container comprising spaced mounting members extending outwardly from said container in spaced parallel relation;

a pin extending from each of said mounting members, said pins being oppositely directed and lying along a common axis; and a handle having a pair of oppositely facing, parallel pin-receiving channels joined at their ends at right angles to a pair of spaced parallel grip members, said pins extending into said channels to join said handle to said bracket;

said container carriable by moving said handle from a resting position to a carrying position using one of two distinct modes of movement.

2. The handle assembly of claim 1 in which the ends of said channels are closed.

3. The handle assembly of claim 2 in which said channels are generally U-shaped to receive said pins and the width of said channels is substantially the same as the diameter of said pins.

4. The handle assembly of claim 3 in which the closed ends of said channels are rounded and the diameter of the rounded ends of said channels is substantially the same as the diameter of said pins.

5. The handle assembly of claim 4 in which the outer surfaces of said grip members are rounded and conform to the shape of the rounded ends of said channels to define a continuous rounded outer surface.

6. The handle assembly of claim 1 in which said mounting members project substantially perpendicular to said container.

7. The handle assembly of claim 6 in which said mounting members are provided with apertures and said pins extend through said apertures into said channels.

8. The handle assembly of claim 7 in which said apertures and said pins are spaced from the surface of said container.

9. The handle assembly of claim 8 in which said pins include shank portions and head portions and the diameter of said shank portions is substantially the same as the diameter of said apertures and the diameter of said head portions is greater than the diameter of said apertures.

10. The handle assembly of claim 9 in which said pins are generally perpendicular to said mounting members.

11. The handle assembly of claim 7 in which said handle is positioned in the space between said mounting members and said pins extend inwardly through said apertures.

12. The handle assembly of claim 11 in which said channels are U-shaped and the openings in said channels face outwardly to receive said inwardly extending pins adjacent said mounting members.

* * * * *